United States Patent [19]

Kaufman et al.

[11] Patent Number: 4,496,368

[45] Date of Patent: Jan. 29, 1985

[54] ISOPROPYLIDENE MALONATE-N-ALKYL ALKYLENEDIAMINE CONDENSATION PRODUCTS

[75] Inventors: Benjamin J. Kaufman, Wappingers Falls; Rodney L. Sung, Fishkill, both of N.Y.

[73] Assignee: Texaco Inc., White Plains, N.Y.

[21] Appl. No.: 505,511

[22] Filed: Jun. 17, 1983

[51] Int. Cl.[3] ..... C10L 1/18

[52] U.S. Cl. ..... 44/63; 44/71; 252/392

[58] Field of Search ..... 44/71, 72, 63; 252/392

[56] References Cited

U.S. PATENT DOCUMENTS

| | | | |
|---|---|---|---|
| 2,331,158 | 10/1943 | Arundale et al. | 44/63 |
| 3,036,904 | 5/1962 | Chafetz et al. | 44/63 |
| 3,135,769 | 6/1964 | Besso | 44/63 |
| 3,337,472 | 8/1967 | Littler et al. | 44/71 |
| 3,522,022 | 7/1970 | May et al. | 44/71 |
| 4,207,079 | 6/1980 | Herbstman et al. | 44/71 |
| 4,412,845 | 11/1983 | Kaufman | 44/63 |

*Primary Examiner*—Y. Harris-Smith

*Attorney, Agent, or Firm*—Robert A. Kulason; James J. O'Loughlin

[57] ABSTRACT

Novel condensation products of N-alkyl-alkylenediamines and isopropylidene malonate are prepared by refluxing the reactants in solvents inert to the reactants, removing this solvent and extracting the reaction system with an inert solvent such as xylene.

2 Claims, No Drawings

ISOPROPYLIDENE MALONATE-N-ALKYL ALKYLENEDIAMINE CONDENSATION PRODUCTS

BACKGROUND OF THE INVENTION

1. Field of the Invention

This invention pertains to new condensation products of derivatives of Meldrum's acid with N-alkyl-1,3-propanediamines and to a method for making same.

2. Overview of the Technology

Meldrum's acid was previously known as the B-lactone of B-hydroxyisopropylmalonic acid and its preparation given in CA 2:1421[7]. Its correct structure was reported in JACS 70, 3246–8 (1948) as isopropylidene malonate (2,2-dimethyl-4,6-diketo-1,3-dioxane). The reaction of this compound with liquid ammonia followed by the evaporation of the ammonia is said in CA 55:22,125[d] as yielding its ammonium salt, of unstated utility. The same reference mentions the reaction of Meldrum's acid with benzenediazonium sulfonate in dilute aqueous $Na_2CO_3$ neutralized with acetic acid as yielding 2,2-dimethyl-1,3-dioxane-4,5,6-trione 5-phenylhydrazone, of unstated utility.

As regards the other reactant used with the present invention, certain N-alkyl-alkylene diamine compounds, as represented by N-oleyl-1,3-diaminopropane, are known to give carburetor detergency properties to gasoline. These additives, however, do not impart corrosion inhibiting properties to gasoline. As a result, a motor fuel containing an N-alkyl-alkylene diamine must be modified or formulated with an additional additive in order to have the necessary corrosion inhibiting properties for marketability.

The known art in no way suggest the reaction of Meldrum's acid-type compounds with N-alkyl-1,3-propanediamines to form compounds useful as carburetor detergents and corrosion inhibitors in gasoline fuels.

SUMMARY OF THE INVENTION

In accordance with a major aspect of this invention there is provided a new class of condensation products of 2,2-di(lower alkyl)-4,6-diketo-1,3-dioxanes and N-alkyl alkylene diamines represented by the formula:

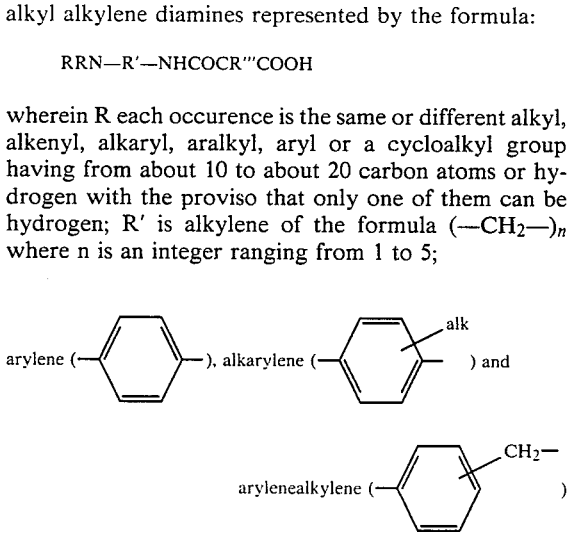

wherein R each occurence is the same or different alkyl, alkenyl, alkaryl, aralkyl, aryl or a cycloalkyl group having from about 10 to about 20 carbon atoms or hydrogen with the proviso that only one of them can be hydrogen; R′ is alkylene of the formula $(—CH_2—)_n$ where n is an integer ranging from 1 to 5;

having about 6 to 30 carbon atoms; R″ and R‴ are both hydrogen or the same or different straight chain or branched (lower) alkyl groups having from about 1 to 5 carbon atoms.

DETAILED DESCRIPTION OF THE INVENTION

In the above compounds, R can be a hydrocarbon group, including inertly substituted hydrocarbon groups, selected from the group consisting of alkyl, aralkyl, cycloalkyl, aryl, alkaryl, and alkenyl including such radicals when inertly substituted. When R is alkyl it can be typically lauryl, myristyl and stearyl. When R is cycloalkyl, it can typically be cyclohexyl, cycloheptyl, cyclooctyl, 2-methylcycloheptyl, 3-butylcyclohexyl, 3-methylcyclohexyl, etc. When R is aryl, it can typically be phenyl, naphthyl and the like. When R is alkaryl, it can typically be tolyl, xylyl and the like. When R is alkenyl, it can typically be vinyl, alkyl, 1-butenyl, and the like. R may be inertly substituted, i.e., it can bear a non-reactive substituent such as alkyl, aryl, cycloalkyl, or ether which does not affect the properties of the compound. Typically, inertly substituted R groups include 3-chloropropyl, 2-ethoxyethyl and the like.

The preferred R groups are alkyl groups containing from 5 to 20 carbon atoms including stearyl (18 carbons); decyl (10 carbons); coco (6–18 carbons); oleyl (12–18 carbons); tallow (12–18 carbons); and soya (14–18 carbons), when B is hydrogen.

Preferably R′ is a straight chain (lower alkylene group containing from 1 to 5, more preferably from 1 to 3 and most preferably 3 carbon atoms.

The invention also provides a gasoline fuel containing a detergent and corrosion-inhibiting amount of at least one compound of the above formula, or a mixture of such compounds.

Additionally the invention provides a novel synthesis for making the compounds defined by the above formula.

DISCLOSURE OF BEST MODE

The starting N-alkyl-alkylene diamine reactants are represented by the formula:

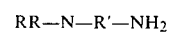

in which, R and R′ are as defined above. As employed herein the term "N-alkyl-alkylene diamine" covers both N-monoalkyl-alkylene diamine and the N-dialkyl-alkylene diamine structure when R′ is a (lower) alkylene radical.

The most convenient alkylene diamines to use are those available commercially under the trade name of Duomeen O (a product of Armak Co.) wherein the alkyl group is straight chain with an average of 12 to 18 carbon atoms and is attached to the nitrogen through the second carbon in the chain. These are available in mixed forms and when used herein will produce a mixture of products of the above formula.

The starting 2,2-di(lower alkyl)-4,6-diketo-1,3-dioxanes have the formula:

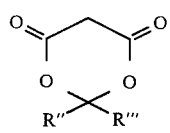

wherein R″ and R‴ are hydrogen or $C_1$–$C_5$ alkyl groups which may be the same or different.

A preferred starting compound is one having R″ and R‴ represented by methyl group.

The compounds of the invention are prepared by refluxing the above described reactants in an inert solvent for the reaction such as acetonitrile, tetrahydrofuran, dimethylformamide, or dimethylsulfoxide, for 2 to 8 hours, removing the solvent, and extracting the reaction mass with xylene, toluene, benzene or cyclohexane.

It will be appreciated that by-products and/or impurities can be co-produced along with the compound of the invention in this reaction. The desired additive compounds can be readily recovered from the reaction product by known methods. However, it is feasible and economical to employ these compounds as produced without separation or purification.

In a specific example, the reaction is carried out as shown in the following equation:

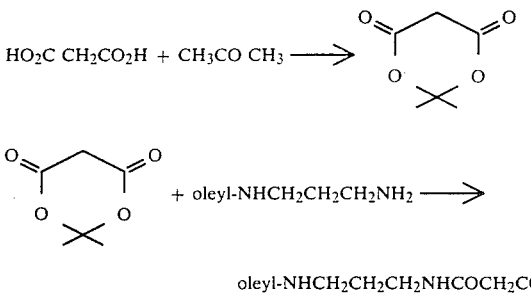

EXAMPLE I

Preparation of Meldrum's Acid

As described in CA 2:1421[7], 52 g. of malonic acid, 60 ml. of acetic anhydride, 1.5 ml. of sulfuric acid and 40 ml. of acetone were stirred at 0° for 8 hours. The solid was filtered and washed with water, giving 37 g. of product.

EXAMPLE II

Preparation of Product 45 g. of N-1(oleyl)-1,3-diaminopropane, 20 g. Meldrum's acid and 100 ml. of acetonitrile were refluxed for 3 hours and the acetonitrile removed by evaporation. 57 g. of product was recovered as a xylene soluble system. Analysis gave the following:

MW=670

%N=4.1

TBN=142.3, 171.9

Results comparable to those of Example II are with compounds prepared as in Example II using the diamines tabulated below in Table I.

TABLE I

| EXAMPLE NO. | DIAMINE |
|---|---|
| 3 | dodecyl—N(octyl)—$CH_2$—$CH_2$—$CH_2$—$NH_2$ |
| 4 | octyl—N(stearyl)—$CH_2$—$CH_2$—$CH_2$—$NH_2$ |

TABLE I-continued

| EXAMPLE NO. | DIAMINE |
|---|---|
| 5 | stearyl—N(lauryl)—$CH_2$—$CH_2$—$CH_2$—$NH_2$ |
| 6 | decyl—N(lauryl)—$CH_2$—$CH_2$—$CH_2$—$NH_2$ |
| 7 | lauryl—N(lauryl)—$CH_2$—$CH_2$—$CH_2$—$NH_2$ |
| 8 | behenyl—N(lauryl)—$CH_2$—$CH_2$—$CH_2$—$NH_2$ |
| 9 | cocoyl—NH—$CH_2$—$CH_2$—$CH_2$—$NH_2$ |
| 10 | stearyl—NH—$CH_2$—$CH_2$—$CH_2$—$NH_2$ |
| 11 | tallow—NH—$CH_2$—$CH_2$—$CH_2$—$NH_2$ |
| 12 | lauryl—NH—$CH_2$—$CH_2$—$CH_2$—$NH_2$ |
| 13 | Myristyl—NH—$CH_2$—$CH_2$—$CH_2$—$NH_2$ |

Results comparable to those of Example II are obtained when the substituted Meldrum acids used are those tabulated below in Table II:

| EXAMPLE NO. | ACID |
|---|---|
| 14 | 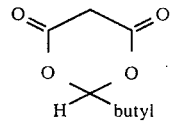 |
| 15 | 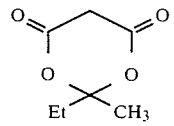 |
| 16 | 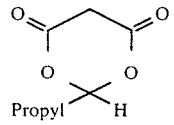 |
| 17 | 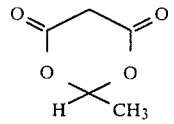 |
| 18 | 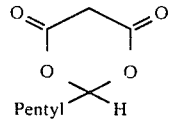 |
| 19 | 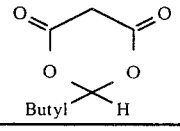 |

The base fuel, in which the additive of the invention is useful, is a mixture of hydrocarbons boiling in the gasoline boiling range. This base fuel may consist of straight-chain or branched-chain paraffins, cycloparaffins, olefins, and aromatic hydrocarbons, and any mixture of these. The base fuel can be derived from straight-run naphtha, polymer gasoline, natural gasoline or from catalytically reformed stocks and boils in the range from about 80° to 450° F. The composition and the octane level of the base fuel are not critical and any conventional motor fuel base can be employed in the practice of this invention.

In general, the additive of the invention is added to the base fuel in a minor amount, i.e., an amount effective to provide both corrosion inhibition and carburetor detergency to the fuel composition. The additive is effective in an amount ranging from about 0.002 to 0.8 weight percent based on the total fuel composition. An amount of the neat additive ranging from about 0.004 to 0.04 weight percent is preferred, with an amount from about 0.004 to 0.012 being particularly preferred, the latter amounts corresponding to about 2.0 to 25 PTB (pounds of additive per 1000 barrels of gasoline), respectively.

The fuel composition of the invention may contain any of the additives normally employed in a motor fuel in an amount sufficient to achieve its intended purpose. For example, the base fuel may be blended with an anti-knock compound, such as a methyl-cyclopentadienyl manganese tricarbonyl or tetraalkyl lead compound, including tetraethyl lead, tetramethyl lead, tetrabutyl lead, and chemical and physical mixtures thereof, generally in a concentration from about 0.025 to 4.0 cc. per gallon of gasoline. The tetraethyl lead mixture commercially available for automotive use contains an ethylene chloride-ethylene bromide mixture as a scavenger for removing lead from the combustion chamber in the form of a volatile lead halide.

To determine the efficacy of the present product, gasoline blends were prepared from a typical base fuel mixed with specified amounts of the prescribed fuel additive of the invention. These fuels were then tested to determine the effectiveness of the additive in gasoline together with comparison fuels in the following performance tests.

The base fuel employed with the additive of Example 2 in the following tests was an unleaded grade gasoline having a Research Octane Number of about 93. This gasoline consisted of about 32 percent aromatic hydrocarbons, 8 percent olefinic hydrocarbons and 60 percent paraffinic hydrocarbons and boiled in the range from 88° F. to 373° F.

In one test, the rust inhibiting properties of the additive was determined in the NACE Test (National Association of Corrosion Engineers) which is a modification of ASTM Rust Test D-665-60 Procedure A. In the NACE Test, a steel spindle is polished with non-waterproof fine emergy cloth. The spindle is immersed in a mixture containing 300 cc fuel and 30 cc distilled water and is rotated at 100° F. for 3.5 hours. The spindle is then rated visually to determine the amount of rust formation. A passing result is an average of less than 5% rust. The results are tabulated below:

| National Association of Corrosion Engineers (NACE) Test) | |
|---|---|
| PTB | Percent Rust |
| 20 | Trace, trace |
| 10 | Trace, trace |
| 5 | 1%, Trace |
| 2.5 | 1%, 1-5% |

The above results show that the fuel composition of the invention was highly effective in inhibiting rust even in as low a concentration as 2.5 PTB.

The effect on carburetor detergency of the fuel composition of the invention was also determined in the Buick Carburetor Detergency Test. This test was conducted as described in coassigned U.S. Pat. No. 4,024,083 and compared with that of a commercial detergent consisting of a mixture of N,N' di($C_1$-$C_{20}$ sec-alkyl) aspartamide in a carrier oil. The test results gave a normalized carburetor rating of 7.0 at 7.5 PTB vs. 5.0 using the same quantity of the commercial detergent indicating superior performance for the composition of this invention.

The additive of the invention also was tested for its effectiveness as a carburetor detergent in the Chevrolet Carburetor Detergency Test as described in coassigned U.S. Pat. No. 4,207,079 and evaluated against a commercially available (Brand X) detergent both at 20 PTB. The present additive showed an 8 percent improvement over Brand X.

The fuel of the invention containing 20 PTB of the compound of Example II was subjected to the Waring Blender Emulsion Test which evaluates the tendency of motor gasolines to form an emulsion or haze with various water bottoms and to examine the stability of such haze or emulsion.

In this test, a mixture consisting of 95 percent test gasoline and 5 percent test water is mixed at approximately 13,000 rpm for 10 seconds in an explosion proof Waring blender. The mixture is transferred to a graduated cylinder, allowed to stand four hours, and the appearance of the water layer is observed visually and the haze of the gasoline layer is measured with a haze meter. Measurements may be made, if desired, at other intervals also, e.g. 24 hours. The higher the absolute number reading the greater the haze.

The results at various pH's are as follows for a 4 hr Haze Reading:

| | Waring Blender Emulsion Test | | |
|---|---|---|---|
| | PTB | pH5 | pH12 |
| Instant | 10 | 28 | 39 |
| Invention | 60 | 19 | 46 |
| "Petrox"[1] | | | |

[1]A commercial additive.

The additive is thus comparable to the commercial additive package at a lower dosage.

The products of the invention can be solids, semi-solids or oils depending upon the nature of the starting reactants. For use as additives in fuels, these products have to be soluble or stably dispersible in a fuel to an extent which allow them to function in their intended manner.

What is claimed is:

1. A fuel comprising a major amount of a mixture of hydrocarbons boiling in the gasoline boiling range and a minor detergent and corrosion-inhibiting amount of the condensation product of a compound represented by the formula:

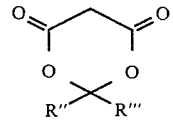

wherein R'' and R''' are hydrogen or $C_1$-$C_5$ alkyl groups and an N-alkyl-1,3-propanediamine in which the alkyl radical has from 6 to 18 carbon atoms.

2. The fuel of claim 1, wherein said amount is about 0.002 to 0.8 weight percent based on the total fuel composition.

* * * * *